US006178251B1

(12) United States Patent
Luchs et al.

(10) Patent No.: US 6,178,251 B1
(45) Date of Patent: Jan. 23, 2001

(54) COLLAR MICROPHONE

(75) Inventors: Michael Luchs; Bruce P. Lancaster; Brendon C. Stead, all of Vancouver, WA (US)

(73) Assignee: Labtec Corporation, Vancouver, WA (US)

( * ) Notice: Under 35 U.S.C. 154(b), the term of this patent shall be extended for 0 days.

(21) Appl. No.: 09/109,468

(22) Filed: Jul. 2, 1998

(51) Int. Cl.[7] ..... H04R 25/00

(52) U.S. Cl. ..... 381/364; 381/362; 381/367; 381/375; 381/385

(58) Field of Search ..... 381/361–64, 367, 381/373–374, 375, 377, 378, 390, 370, 376, 15, 380; 379/430

(56) References Cited

U.S. PATENT DOCUMENTS

| | | | | |
|---|---|---|---|---|
| 306,296 | | 10/1884 | Vail . | |
| D. 361,066 | | 8/1995 | Langhorn et al. . | |
| 1,332,873 | * | 3/1920 | Jensen | 381/367 |
| 2,566,313 | | 9/1951 | Cates . | |
| 2,611,831 | | 9/1952 | Cates . | |
| 3,928,734 | * | 12/1975 | Noury | 381/364 |
| 4,685,448 | | 8/1987 | Shames et al. . | |
| 4,993,065 | | 2/1991 | Chiou . | |
| 5,163,093 | | 11/1992 | Frielingsdorfer et al. . | |
| 5,457,751 | | 10/1995 | Such . | |
| 5,520,198 | * | 5/1996 | Lin | 131/330 |

FOREIGN PATENT DOCUMENTS

| | | |
|---|---|---|
| 9914205 | 9/1999 | (GB) . |
| 1029192 | 1/1989 | (JP) . |

* cited by examiner

*Primary Examiner*—Wing F. Chan
*Assistant Examiner*—Dionne Harvey
(74) *Attorney, Agent, or Firm*—Ipsolon llp

(57) ABSTRACT

A collar band supports a boom-mounted microphone that may be selectively positioned on either the right or left side of the user's head. Adjustable neck pads are mounted to the opposite ends of the collar band for added comfort. The collar band may be resized to fit the neck of the user. The collar microphone may be worn for extended periods of time without becoming uncomfortable. A cradle assembly conveniently supports and stores the microphone when it is not in use.

8 Claims, 6 Drawing Sheets

Fig. 1
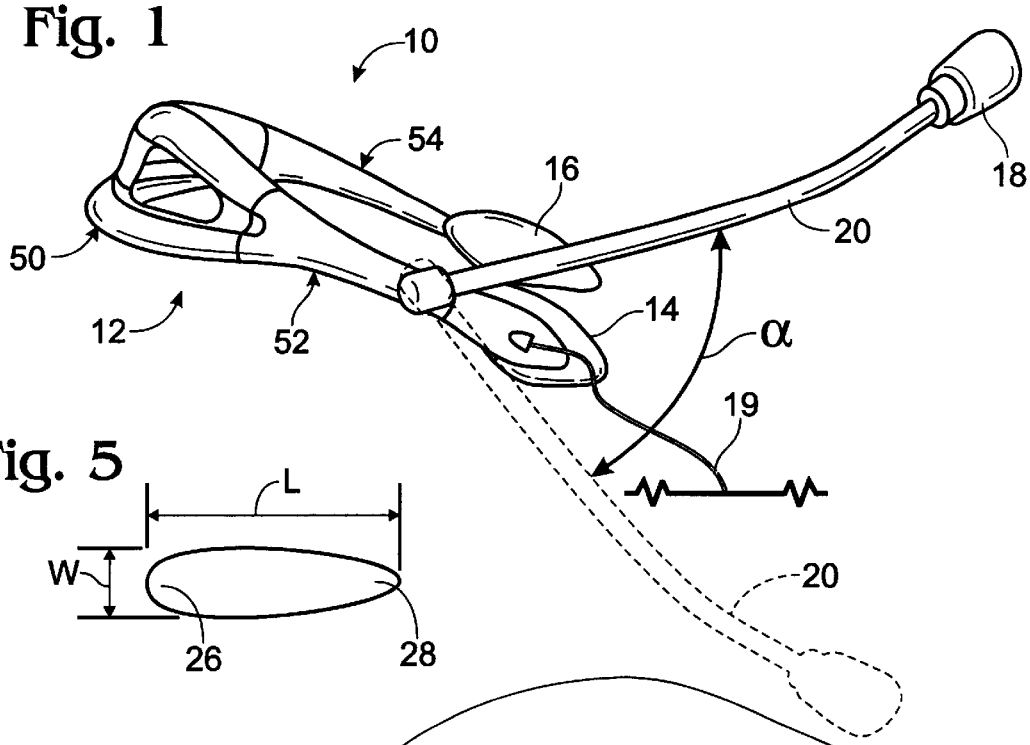
Fig. 5
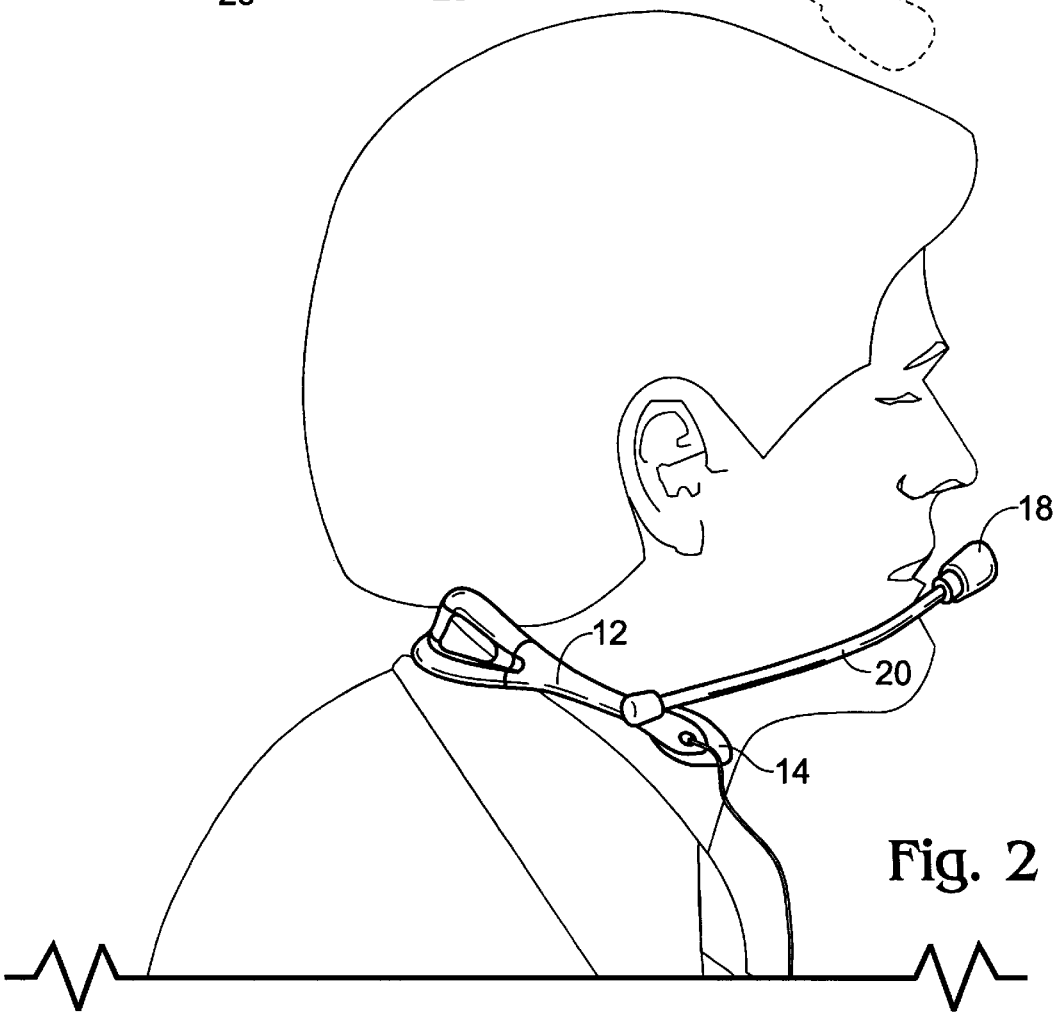
Fig. 2

Fig. 3
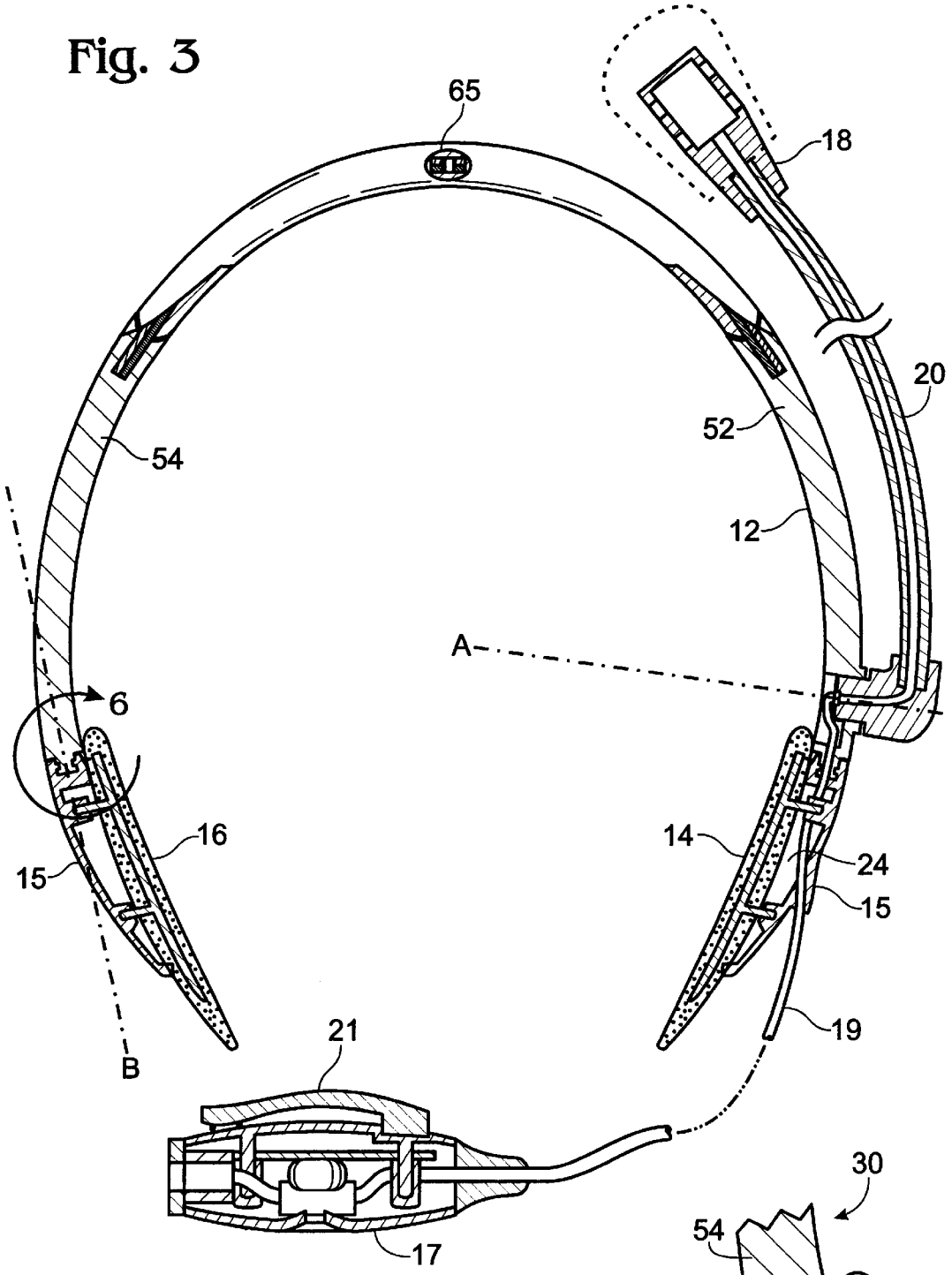
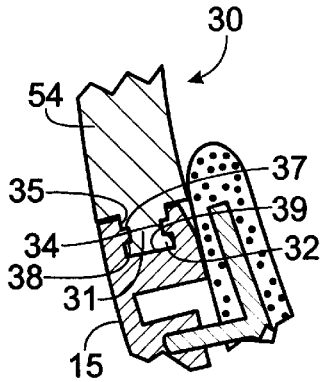
Fig. 6

COLLAR MICROPHONE

FIELD OF THE INVENTION

This invention relates to a collar band worn around the neck of a user, which supports an attached microphone.

BACKGROUND AND SUMMARY OF THE INVENTION

Microphones are often attached to headsets. Such headset microphones are used daily in many industries to transmit spoken audio information. A few examples include microphones used by musicians, airplane pilots and telephone operators and receptionists. Headset microphones are often preferred over stationary microphones because use of a headset allows for greater degree of movement. Whereas a stationary microphone—for instance a microphone at a podium—mandates that the speaker remain in close proximity to the microphone, a headset microphone allows the speaker to move about with relative freedom.

With the burgeoning importance of computer audio applications such as speech recognition and dictation, Internet telephones, computer telephony and video conferencing, the use of headsets with attached microphones to input audio information into computers has become commonplace. For instance, many computer users create electronic documents through the use of speech recognition software. With these applications, the user creates an electronic document by dictating directly into the computer through a microphone. Similarly, Internet telephones allow real-time audio communications to occur simultaneously between users over the Internet and other computer networks. Many such applications require near-field microphones in which the microphone element is positioned very close to the user's mouth to improve cancellation of background noises. Headsets are the conventional devices for providing such positioning.

Various microphone-input devices, including headsets, have been developed for use in conjunction with computer technologies. Traditional headsets with one or two earphones may be used in conjunction with a microphone. However, earphones or ear pads that directly contact the user's ears, for instance, either by partially or completely covering the auricles, have a tendency to be uncomfortable. This is especially true when the headset is worn for an extended period of time, as is often required when the headset is used in connection with a computer. Because the earphones rest on the soft tissue of the auricle, there also may be pressure points that lead to further discomfort. Earphones that include a speaker are often relatively heavy since each speaker requires a driver. As a result, even a monaural headset that has only one earphone may be uncomfortable when used for an extended period, such as when dictating documents into a computer.

Some kinds of headsets with microphones utilize ear bands or clips of various designs in place of the headbands to provide support for the microphone. For example, a headset ear piece such as that shown in U.S. Design Patent Des.363,487 may be used in connection with a microphone connected to the ear piece. The ear piece supports the microphone, which is adjustable so it may be moved into proximity with the user's mouth. However, ear clips, which are typically designed for placement between the auricle and the temporal bone in the manner of an ear piece on a pair of eyeglasses, may become uncomfortable when worn for extended periods of time. And even though the microphone and the associated boom may be relatively lightweight, all of the weight of the headset and microphone is supported by the user's ear.

Another example of a headset is shown in U.S. Pat. No. 5,457,751. The "ergonomic" headset shown in this patent is designed to be worn with the framework of the headset behind the user's head, and supported in part by the nape of the user's neck. The headset shown in this patent includes ear supported members that rest above and behind the user's ear and conform to the cleft between the auricle and the temporal bone. These ear supported members carry various attachments such as a microphone or speakers. However, since the ear supported members make direct contact with the area at the cleft between the user's ear and the temporal bone, in the same way the ear pieces of a set of eyeglasses contact the ears, the headset may have a tendency to become uncomfortable.

An alternative to the use of headsets in connection with inputting audio information into computers is to use desktop microphones, or microphones that are mounted to, for instance, a computer monitor. When such desktop input devices are used, traditional loudspeakers adapted for use with computers may be used to play back the audio output. The use of a desktop microphone is advantageous because the user's ears are not obstructed and the user may stay in touch with his or her surroundings and may hear, for example, the telephone or a co-worker who stops by. However, like a microphone at a podium, a desktop microphone requires that the user speak directly into the microphone, and in most cases in close proximity to it. This limits the user's range of movement and may lead to fatigue when the microphone is used for any length of time. In other words, the user must dictate directly into a stationary microphone and therefore does not have the option of moving about while using the microphone.

Accordingly, the comfort, functionality and design of microphones have become critical, particularly for microphones used for computer audio applications.

Some computer users have alleviated the problems associated with the headset microphones described above by wearing the headset around the neck, making appropriate adjustments to the orientation of the microphone so that it rests in proximity to the user's mouth. This manner of wearing a headset microphone has also been applied to microphones used in other settings, such as by auctioneers who often use microphones with wireless systems. However, while shifting a headset from the traditional over-the-head position to an around-the-neck position may decrease fatigue to the user's ears, traditional headsets are neither engineered nor designed for wearing around the neck. As a result, ear phones, ear pads and the like do not find a comfortable resting place on the user's neck. Specifically, traditional round or rectangular ear pads that are designed primarily for wearing on the ears are either too large or inadequately shaped to be worn comfortably on the neck, leading to discomfort. In addition, the radius of curvature of a headband designed for wearing over the head may be significantly different from the radius of curvature of a neck. Further, the length of a boom supporting a microphone from a headset to be worn over the head does not correctly position the microphone when the headset is worn around the neck. For all of these reasons, a need exists for a comfortable microphone that may be worn around the user's neck.

The present invention provides a collar band with an attached microphone that is especially designed for use with computer audio applications. The collar microphone eliminates earphones and ear pads, replacing them with neck pads that are specifically designed for wearing around the user's ear. The collar band has a radius of curvature that may be adjusted to comfortably fit any neck size. The collar microphone of the present invention is well suited to be worn for extended periods of time. By eliminating speakers, the user's ears are left unobstructed, thereby leaving the user with "free ears" to keep in touch with what is going on in the user's surroundings. The collar band supports the entire weight of the microphone, which is adjustably mounted to the collar band such that it may be positioned in proximity to the user's mouth, on either side of the user's head.

BRIEF DESCRIPTION OF THE DRAWINGS

FIG. 1 is a right side perspective view of a preferred embodiment of the collar microphone of the present invention.

FIG. 2 is a right side perspective view of the embodiment of FIG. 1, shown with the collar worn around a user's neck.

FIG. 3 is a cross sectional view of the collar band, microphone and an attached mute switch according to the present invention.

FIG. 5 is a plan view of a neck pad of the present invention.

FIG. 6 is a close up circle cross sectional view of the left side neck pad assembly shown in FIG. 4.

DETAILED DESCRIPTION OF PREFERRED EMBODIMENTS

Figure 4:
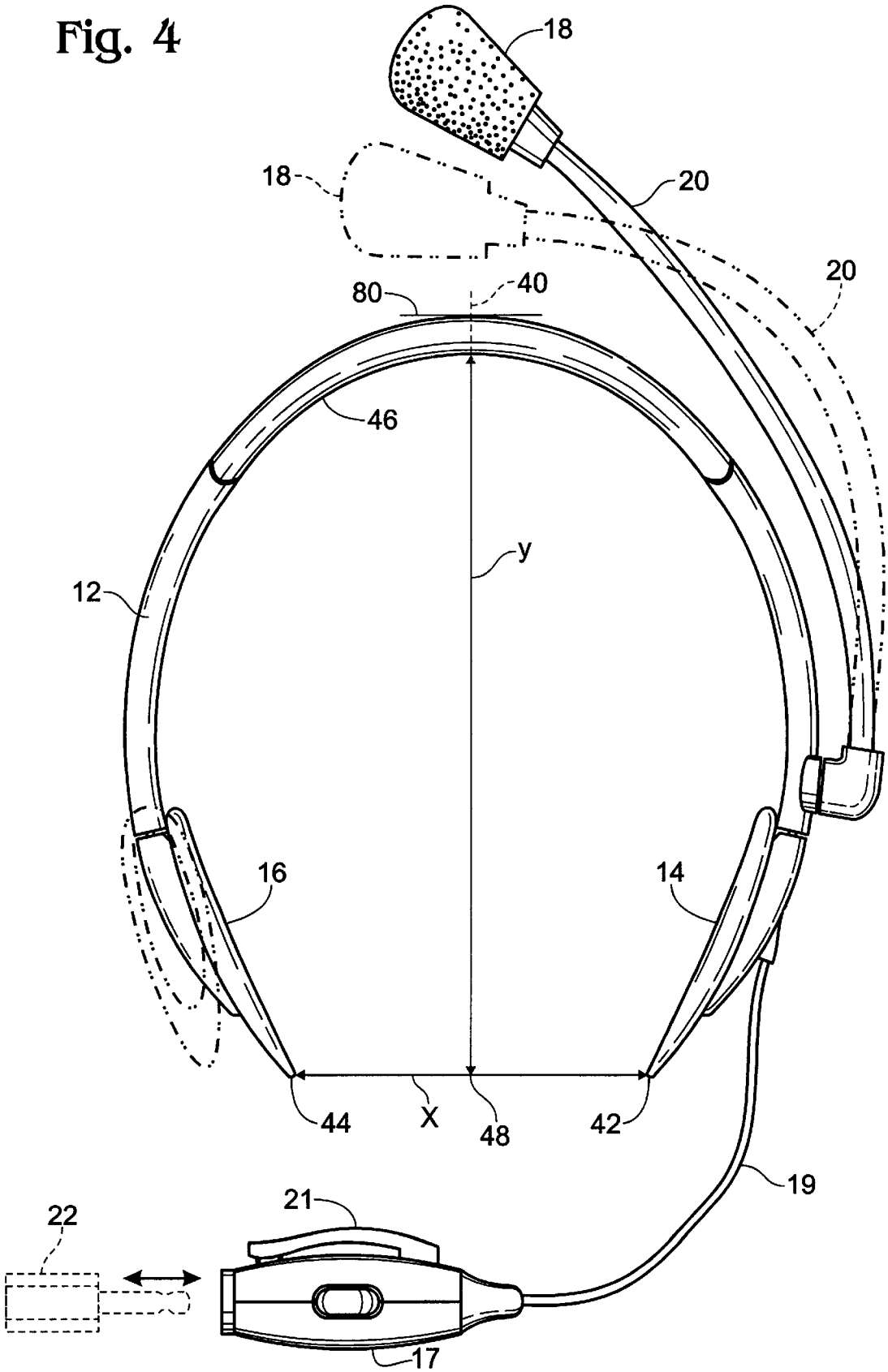
FIG. 4 is a top view of the collar microphone of the present invention.

FIG. 1 illustrates a preferred embodiment of collar microphone 10, which includes a resilient arcuate collar band 12 having at its opposite ends a pair of extension arms 52, 54. Adjustable neck pads 14, 16 are attached to the outer ends of the extension arms. A microphone 18 is mounted to the distal end of a flexible microphone boom 20, which is pivotally connected at its opposite end to right side extension arm 52 adjacent its connection to right side neck pad 14. The microphone, which is typically covered with a foam pad or bulb, is electrically connected to a mute switch 17 through a wire 19 (FIG. 3). The mute switch includes a clip 21 designed to be attached to the user's garment, such as a shirt pocket or lapel. A plug 22 connected to cable that is in turn connected to the computer (not shown) is inserted into switch 17 to complete the electrical connection between the microphone and the computer (FIG. 4). Since the user wears the collar band and the mute switch, and the mute switch is detachable from the electrical connection with the computer at plug 22, the user may disconnect the electrical connections at the mute switch and move about freely without having to remove the collar band. The mute switch allows the user to mute the system when necessary so that audio input is not transmitted to the computer, for instance when the user is talking on the telephone.

References herein to sides—right side, left side, etc.—are based upon the orientation of the collar microphone as it is worn around a user's neck, and with regard to the right or left hand side of a user. For example, FIG. 2 shows the collar band worn such that the attached microphone boom 20 is placed on the right hand side of the user's mouth. Accordingly, the neck pad 14 that is worn on the right hand side of the user's neck is referred to as the right side neck pad. However, as described more fully below, the collar microphone of the present invention may be worn around the user's neck with the microphone positioned on either side of the user's mouth. As such, references to one side or the other are relative and are for illustrative purposes only. Similarly, references to an inner or an outer side refer to the apparatus as it is worn on a user. Thus, a reference to an inner side or surface of the collar microphone refers to the side or surface adjacent the user when the apparatus is being worn.

The collar microphone of the present invention does not include any speakers or other devices through which audio signals may be played back. The collar microphone is accordingly very light. Standard audio monitors that are used with, for example, a computer may supply audio output, if such output is needed or desired in any particular application.

Figure 7:
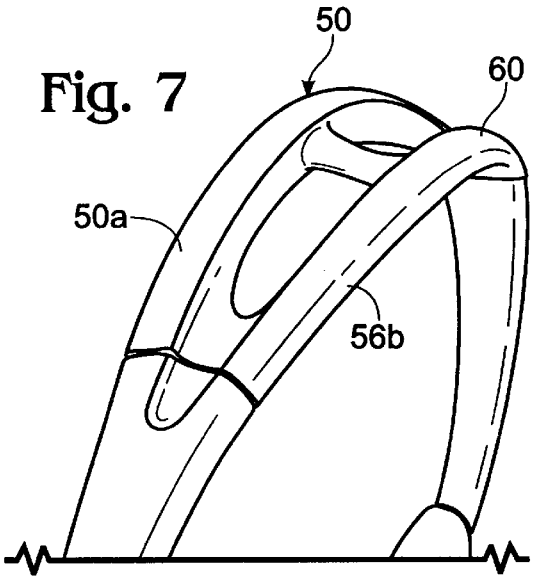
FIG. 7 is a perspective view of a portion of the collar band of the present invention.

As shown in FIG. 2, collar band 12 is configured for wearing around the back of the user's neck, near the nape of the neck, and may be worn on either the inside or the outside of the collar on the user's clothing. Collar band 12 is constructed of three sections: center section 50, and a pair of extension arms attached to the opposite outer ends of the center section, namely right side extension arm 52 and left side extension arm 54. Center section 50 is split into two separate bands, 50*a* and 50*b* (FIG. 7), which rejoin to form a single band on opposite ends. At its center, central section 50 of the collar band is wider than the opposite end portions and provides a broader base that rests on the user's neck or collar.

Figure 8:
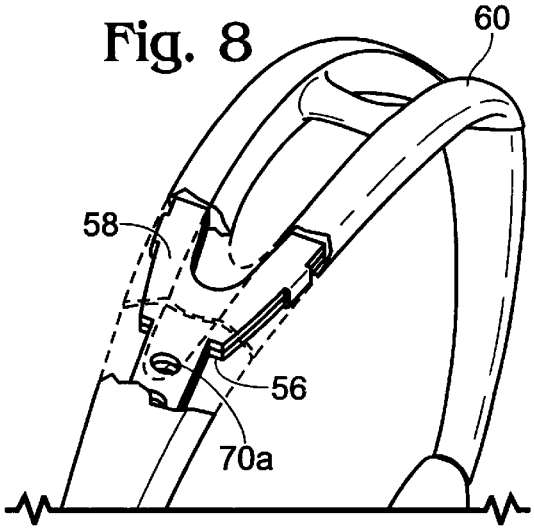
FIG. 8 is a perspective view as shown in FIG. 7 with an outer section of the collar band cut away to show the interior of the collar band.
Figure 9:
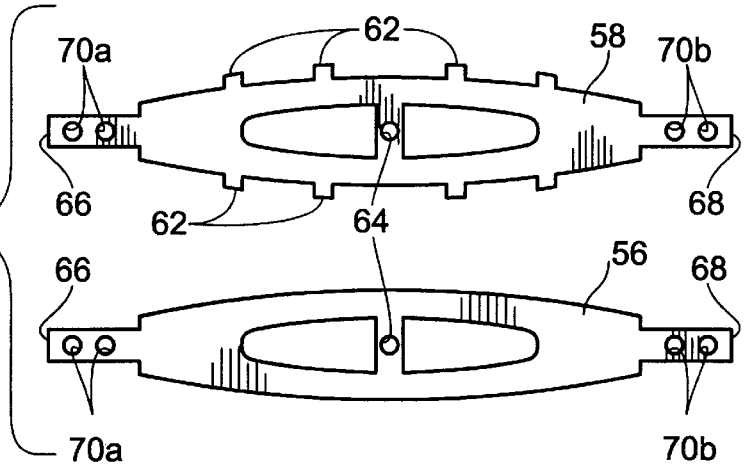
FIG. 9 is a plan view of the two metallic plates that are molded into the collar band.

Center section 50 is constructed to be flexible so that the center section can be resized to fit any size neck. Referring to FIGS. 7 through 10, center section 50 includes two metal plates, an inner plate 56 and an outer plate 58. As the unit is assembled and as illustrated in FIG. 8, the two metal plates are mated together and overmolded with a rubber compound 60 that covers the combined metal plates. The rubber coating adds to the comfort of the collar band and helps to hold the position of the collar band on the user's neck.

Outer plate 58 is formed of a malleable metal composition that can be bent along the longitudinal axis extending through the plate. Because the metal in the plate 58 is malleable, the plate will remain in the shape into which it is bent. Inner plate 56, which has substantially the same shape as the outer plate, is formed of a resilient spring steel compound. While plate 56 may be bent in the same manner as plate 58, unlike plate 58, which will retain the shape into which it is bent, the resiliency of plate 56 urges the plate back to its original shape when bent.

Figure 10:
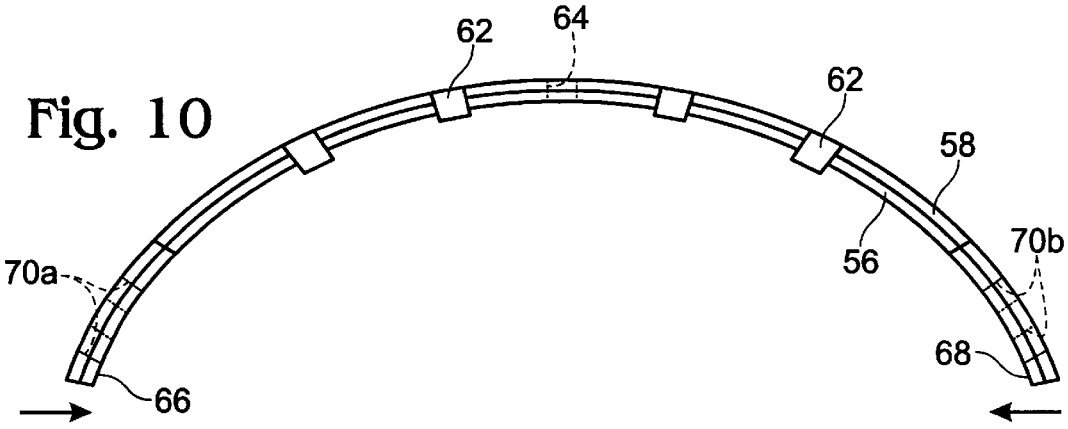
FIG. 10 is a side view of the two metallic plates shown in FIG. 9 as they are assembled in the collar band.

Plates 58 and 58 are assembled by mating, or sandwiching the two plates together. When the two plates are mated together, plural tabs 62 extending from and spaced about the periphery of outer plate 58 are bent over inner plate 56 to hold the two plates together in a mated position. FIG. 10. The two plates are then fixed to one another at common center apertures 64, for instance with a rivet 65 (FIG. 3). Tabs 62 are bent over inner plate 56 such that they form a sleeve that holds the inner plate in close proximity to the outer plate.

The combination of the two kinds of metal plates provides flexibility and resiliency in the center section 50 of the collar band. Specifically, while the two plates are fixedly joined at their common center apertures 64, the plates may be bent along the longitudinal axis extending through the plates. In the relaxed position of the bands shown in FIG. 10 the plates define an arcuate path for the collar band having a radius of curvature. The radius of curvature of the arcuate path may be altered by bending the combined plates to, for instance, increase or decrease the radius of curvature of the arcuate path. The malleable metal in the outer plate allows the center section to be bent to achieve a desired radius of curvature. Since the metal in the outer plate is malleable, the center section will remain in the shape into which it is bent. Regardless of the shape into which the combined plates are bent, the spring steel of inner plate 56 urges the opposite ends of the plates, labeled 66, 68 respectively in FIG. 10, back toward their relaxed shape. In FIG. 10, for example, the spring steel of inner plate 56 urges the opposite ends of the plates 66, 68 inwardly in the direction of the arrows. In the assembled unit the resiliency of the spring steel plate thus urges the neck pads inwardly against the user's neck with a slight amount of pressure. The combination of a malleable metallic plate with a spring steel plate thus allows for a high level of adjustment and comfort of the collar band. Even with prolonged use and multiple adjustments the center section of the collar will not get "kinks" or otherwise become deformed.

It will be appreciated that the radius of curvature that the outer plate 58 follows is slightly greater than the radius of curvature that the inner plate 56 follows. Accordingly, as the mated plates are bent to alter the radius of curvature of the combined plates, the plates move relative to one another, although the plates are fixed together at apertures 64. The plural tabs 62 allow for this relative movement of one plate against the other.

Extension arms 52 and 54 are attached to the outer ends of center section 50 at paired apertures 70*a* and 70*b* formed through the plates at the opposite ends 66, 68 thereof. When the plates are assembled the paired apertures align as shown in FIG. 8. Paired posts or clips in apertures in the extension arms configured to receive the ends of the plates (not shown) insert into the paired apertures in the plates to join the extension arms to the plates and retain the extension arms in place. The outer diameter of the posts is less than the diameter of the paired apertures 70*a*, 70*b*, to allow for the relative movement of the inner plate against the outer plate as the center section is adjusted.

Referring to FIG. 3, microphone boom 20 is pivotally mounted to right side extension arm 52 adjacent the connection with right side neck pad 14. Boom 20 is mounted for pivotal rotation about an axis A (shown as dashed line A in FIG. 3) through an arc of rotation $\alpha$ of less than 360°, as illustrated by the dashed line drawings in FIG. 1. The minimum arc of rotation of the boom is about 270°. Internal stops (not shown) prevent the boom from rotating in a full 360° circle about its connection on the collar band. By allowing for a sufficient arc of rotation of the boom about its connection on the collar band and about axis A, the user may wear the collar band with the boom positioned on either the right hand side or the left hand side of the user's head. Thus, by rotating the boom from one position to another the user may selectively adjust the boom so that the collar band may be worn with the microphone positioned on either the right hand side of the head, or on the left hand side of the head. For instance, in FIG. 2 boom 20 is shown worn on the right hand side of the user's head. By rotating the boom approximately 90° in the clockwise direction in FIG. 2, and by then reversing the orientation of the collar band on the user's neck such that the right side neck pad 14 is worn on the left hand side of the user's neck, the microphone will again be positioned adjacent the user's mouth, but will be worn on the left hand side of the user's neck.

Boom 20 is made of a flexible material that permits the user to adjust the position of the microphone to the position that is optimal for speaking into the microphone, regardless of which side of the head the boom is positioned on, as shown by the dashed line drawing in FIG. 4.

Each neck pad is mounted to a base 15 that is pivotally connected to a distal end of the extension arm to allow the base, and the associated neck pad, to rotate about the axis extending generally longitudinally through the bases (shown as dashed line B in FIG. 3). Rotation of the bases 15 about these axes permits adjustment of the neck pads to fit the contours of the user's neck or collar. With reference to left side neck pad 16, base 15 and thus the neck pad may be rotated through an arc of 360° about axis B. The dashed line drawing in FIG. 3 illustrates base 15 and left side neck pad 16 rotated about 90° about axis A.

Referring to right side neck pad 14, wire 19 extends through a passageway 24 in base 15, through a communicating passageway extending through the connection between the base and the collar band, and to the microphone. Rotation of the right side neck pad through a full circle about axis B could damage wire 19 and associated electrical connections. Therefore, stops (not shown) are provided in base 15 to limit the arc of rotation of the base to less than 360°, and preferably about 350°.

Referring to FIG. 6, the distal end 30 of extension arm 54 has a circular post 31 extending therefrom. A circular flange 32 on the end of post 31 defines an adjacent circular groove 34 and a shoulder 37. A reduced diameter circular aperture 35 formed in the end of base 15 opens into a cavity 39, defining a shoulder 38. Cavity 39 is sized to receive flange 32. When assembled, flange 32 is received into the cavity and shoulder 37 abuts shoulder 38, thereby retaining base 15 in position on the end of the collar band yet allowing base 15 to rotate about the B axis. Right side neck pad 14 is connected to the opposite end of extension arm 52 in a similar manner. However, as noted above, stops prevent rotation of the base and neck pad in a full circle about the axis.

Since the microphone boom is mounted to the extension arm, the neck pads may be rotated independently of the microphone boom, and regardless of which side of the neck the boom is positioned on.

Like the center section 50 of collar band 12, the neck pads are made of a soft material such as rubber and are specifically designed to rest comfortably on a user's neck in the area located immediately above the clavicles, as shown in FIG. 2. The rubber material is not only more comfortable, but also more likely to stay in place on the user's neck or collar. The neck pads may be adjusted according to user preference. When worn in the position shown in FIG. 2, the entire weight of the unit is supported by those portions of the neck that are in contact with the collar band and neck pads.

The neck pads define neck-contacting surfaces that contact the user's neck or collar when the collar band is in use. The neck pads are preferably formed in the shape of an elongate oblong having a first end 26 that is relatively wider than a second, relatively narrower end 28. FIG. 5. The neck pads taper from the wider toward the narrower end. The pads have a length L and a width W, each of which represents the maximum dimension along the neck-contacting surface of the pad. In the preferred embodiment the length is at least about 3 times the width, and the width is no more than about 2 centimeters. More preferably, the width is about 1.7 centimeters and the length is about 3.5 times the width. The design and dimensions of the neck pads contribute to the comfort of the collar microphone. Since the neck pads rest in the area above the clavicles the pads themselves are preferably designed to be relatively long and narrow. In contrast, traditional headsets with earphones that are intended for covering the user's ears—and which are either substantially round or are in the shape of a relatively large rectangle—do not fit comfortably on the neck.

With reference to FIG. 4, the collar band defines an arcuate path and has a collar band length measured along the arcuate path. The collar band length is defined as the distance along the collar band path between the point on one neck pad that contacts the user's neck and which is furthest from a center point 40 on the collar band and the same point on the opposite neck pad. The collar band length of the present invention is fixed. In FIG. 4 the points on the neck pads that contact the user's neck and which are furthest from center point 40, and thus define the collar band length, are labeled 42 and 44, respectively. The collar band path is substantially bilaterally symmetric about the center point. Because the collar band length is fixed, the precise location at which the neck pads rest on the neck of a user will vary with such factors as the size of the user's neck. Nonetheless, because the neck pads are oblong they rest comfortably on the user's neck in the area generally located above the clavicles.

A collar band height is defined with respect to a height line Y that is perpendicular to a tangent line 80 at center point 40. The collar band height is the distance along line Y from the inner surface 46 of collar band 12 to an intersection with a line X that is perpendicular to line Y and extends to the outer point on a neck pad that is furthest removed from center point 40 along the collar band path. In FIG. 4, the outer points on the neck pads 14 and 16 that are furthest removed from center point 40 in the collar band path are labeled 42 and 44, respectively. Accordingly, in FIG. 4 the collar band height is the distance along line Y from the inner surface 46 to the point 48 where line Y intersects line X.

Figure 11:
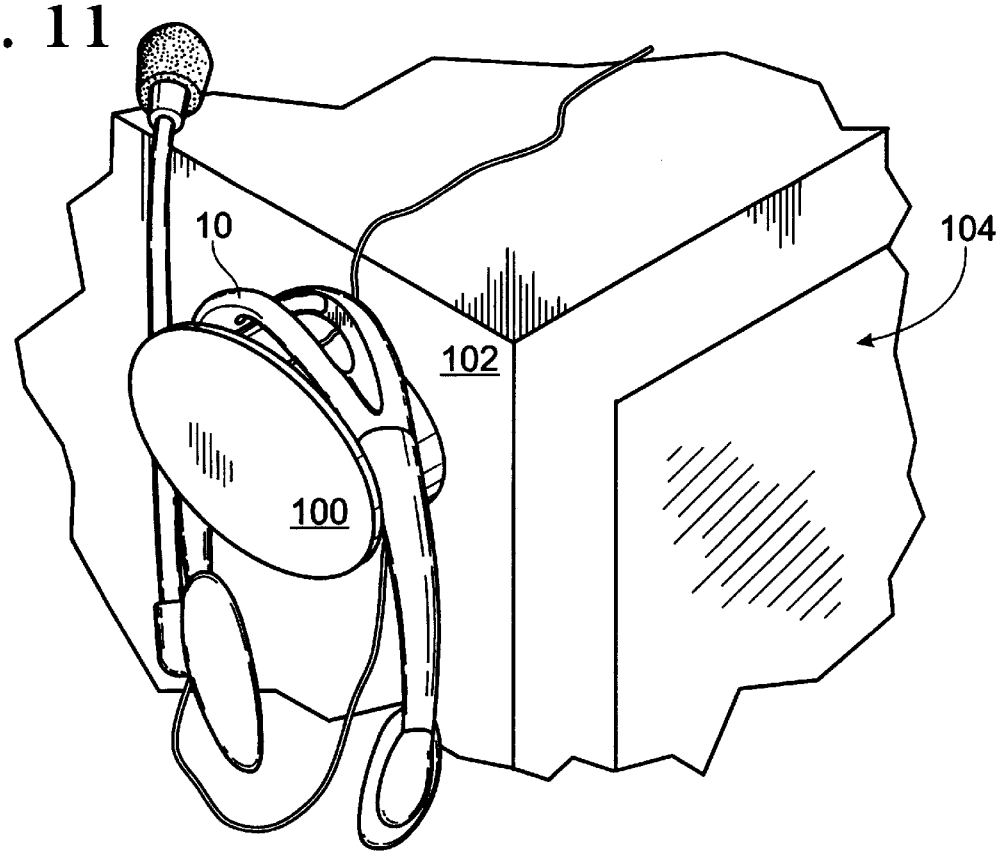
FIG. 11 is an isometric view of a microphone cradle assembly supporting and storing a collar microphone while it is not in use.

FIG. 11 is an isometric view of a cradle assembly 100 supporting and storing collar microphone 10 while it is not in use. Cradle assembly 100 is shown attached to a side surface 102 of a computer display monitor 104 (partly shown). In this implementation, cradle assembly 100 is attached to display monitor 104 with double-sided adhesive tape 105 (FIGS. 12 and 13), although other suitable attachments may be used.

When attached to display monitor 104, cradle assembly 100 secures collar microphone 10 in a location that does not clutter a user's desk or other workspace while also keeping collar microphone 10 conveniently accessible. It will be appreciated, however, that cradle assembly 100 could be attached to virtually any other surface or article in proximity to the associated computer. Moreover, cradle assembly 100 could alternatively support and store any other headphone or band-mounted microphone. Collar microphone 10 is referenced specifically in the description of cradle assembly 100 merely for purposes of illustration.

Figure 12:
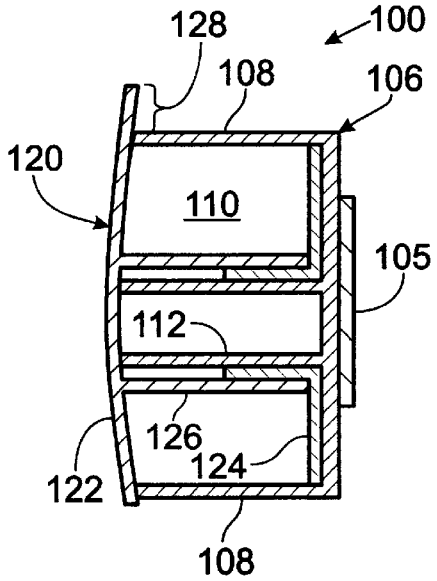
FIGS. 12 and 13 are sectional side views showing the cradle assembly of FIG. 11 in partly open and closed, respectively.
Figure 13:
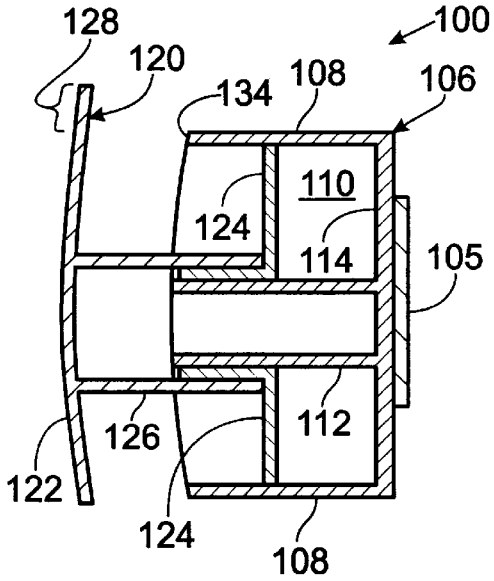

FIGS. 12 and 13 are sectional side views showing cradle assembly 100 in partly open and closed positions, respectively. Cradle assembly 100 includes a stand 106 with an outer perimeter 108 and an interior 110 having a generally central post 112 that extends longitudinally outward from a rear surface 114. A cap assembly 120 has a complementary fit with stand 106 and fits with it to generally enclose interior 110.

Cap assembly 120 includes a cap 122 and a base 124 that are positioned at opposite ends of a stem 126. When cap assembly 120 is fitted to stand 106, base 124 is positioned toward (e.g., against) rear surface 114, post 112 extends into and along stem 126, and cap 122 generally closes interior 110. Post 112 and stem 126 may have elliptical, oval, or other non-circular cross-sections to assure that users fit cap assembly 120 and stand 106 together with a particular orientation.

Cradle assembly 100 functions as a hanger over which a banded headphone, band-mounted microphone, or collar microphone 10 (i.e., a banded phone) is hung for storage. Cap 122 includes an extended lip 128 that extends beyond at least a portion of perimeter 108 (e.g., a top portion) to prevent collar microphone 10 from inadvertently slipping off cradle assembly 100. Collar microphone 10 and most banded headphones and band-mounted microphones include a wire for coupling to a computer, for example. Cradle assembly 100 provides storage of such wires, which can be draped over cradle assembly 100 with microphone 10 or positioned within interior 110. Extended lip 126 also prevents wires draped over cradle assembly 100 from slipping off.

The microphone wires may be stored within cradle assembly 100 to provide a neater desktop or workspace appearance when the microphone is not in use. For example, the wire can be wrapped around stem 126 when cap assembly 120 is removed, either partly or completely, from stand 106. The wire portions extending to the microphone and to the computer jack would pass between cap 122 and stand 106. In this implementation, accommodations for these wire portions allow cap assembly 120 and stand 106 to remain fitted closely even with these protruding wires.

Figure 14:
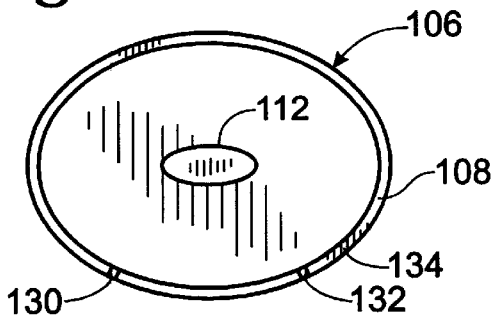
FIGS. 14 and 15 are respective front and bottom views of a stand included in the cradle assembly of FIG. 11.
Figure 15:
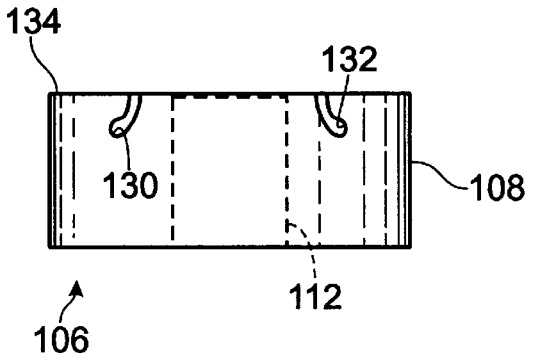
Figure 16:
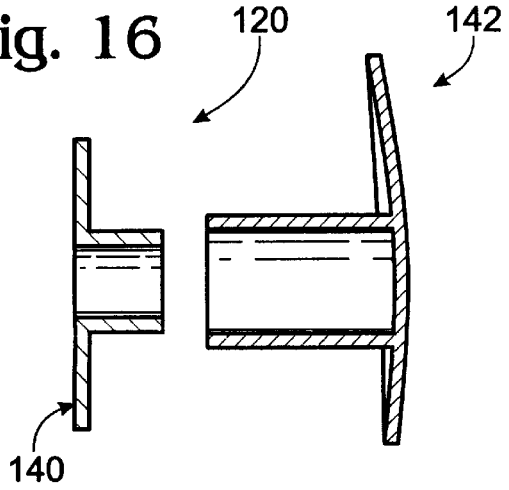
FIG. 16 is an exploded side view of a cap assembly included in the cradle assembly of FIG. 11.
Figure 17:
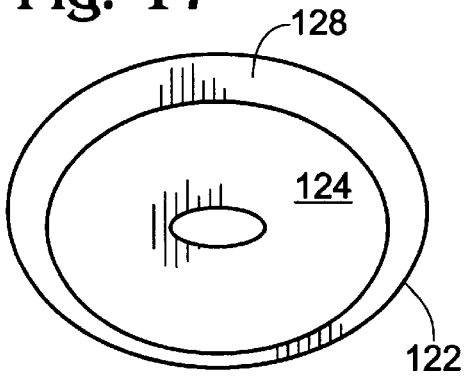
FIG. 17 is a rear view of the cap assembly.

FIGS. 14 and 15 are respective front and bottom views of stand 106 showing a pair of slots 130 and 132 within a bottom portion of perimeter 108. Slots extend inwardly from an outer edge 134 of perimeter 108. In this illustration, slots 130 and 132 are canted away from each other. FIG. 16 is an exploded side view of cap assembly 120, which includes a cap portion 140 and a base portion 142 that are secured (e.g., bonded) together when assembled. FIG. 17 is a rear view of cap assembly 120 illustrating extended lip 128 relative to perimeter 108 (in dashed lines) of stand 106. This illustration shows that extended lip 128 extends beyond perimeter 108 over half of its extent.

While the present invention has been described in terms of a preferred embodiment, it will be appreciated by one of ordinary skill that the spirit and scope of the invention is not limited to those embodiments, but extend to the various modifications and equivalents as defined in the appended claims.

What is claimed is:

1. A method of supporting a microphone around the neck of a user, comprising the steps of:

positioning around the user's neck an arcuate resilient collar band defining an arcuate collar band path, the collar band having opposite ends defining an open section therebetween and an elongate neck pad rotatably connected to each opposite end, each neck pad having a length that is at least about 2 times greater than its width, and a width of no more than about 2 centimeters thereby defining a longitudinal axis, a neck pad mounted to each opposite end of said collar band such that said neck pad is substantially in the collar band path, and wherein said open section is located at a front portion of the collar band and each neck pad is rotatable about the longitudinal axis;

positioning in an operative position in the vicinity of the user's mouth a microphone mounted to the collar band, wherein the microphone is mounted on the distal end of a microphone boom that is pivotally connected at its opposite end adjacent said end of the collar band to permit rotation of the microphone boom about a first axis, and wherein the second positioning step includes the step of pivoting said microphone boom about said first axis.

2. The method of claim 1 wherein the first positioning step includes the step of adjusting the rotational position of each neck pad about said longitudinal axis.

3. The method of claim 1 wherein the neck pads are configured for resting on the user's neck in the area of the clavicles.

4. A collar microphone comprising:

a resilient arcuate collar band having opposite distal ends defining an open section therebetween at a front portion thereof, the collar band defining an arcuate collar band path and the collar band including a deformable section opposite the open section configured for varying the collar band path;

an elongate neck pad defining a longitudinal axis and rotatably mounted to each of the opposite distal ends such that said longitudinal axis is substantially in the collar band path, each neck pad mounted to the respective distal end in the collar band path for rotation about the longitudinal axis;

a microphone boom having a microphone at one end and connected at the opposite end to the collar band to permit pivotal rotation of the microphone boom.

5. The collar microphone of claim 4 wherein the neck-contacting surface defines an elongate oblong having a first wider end adjacent the distal end of said collar band and wherein said neck-contacting surface tapers to a second narrower end in the direction from said first wider end to said second narrower end.

6. In a method of supporting a microphone in an operative position in the vicinity of a user's mouth, wherein the microphone is of the type worn by the user to permit the user to move about while the microphone is in use, the improvement comprising:

locating around the user's neck a resilient arcuate collar band having opposite ends defining an opening therebetween and a collar band path, said collar band having an elongate neck pad defining a longitudinal axis rotatably connected to each opposite end such that the longitudinal axis of said neck pad is substantially in the collar band path, each neck pad defining a neck-contacting surface, said surface having a length and a width, wherein said length is at least about twice said width, and said width is no more than about 2 centimeters and wherein the locating step includes positioning the opening at a front portion of the user's neck and rotating said neck pads about said neck pad longitudinal axis.

7. The method of claim 6 wherein each neck pad defines an elongate oblong neck-contacting surface having a first wider end adjacent the distal end of said collar band and wherein said neck-contacting surface tapers to a second narrower end in the direction from said first wider end to said second narrower end, and wherein each neck-contacting surface is configured for contacting the user's neck in the area of the clavicles.

8. The method of claim 6 wherein the microphone is mounted on the distal end of a microphone boom that is pivotally connected at its opposite end to said end of the collar band to permit rotation of the microphone boom about a first axis, and wherein the second locating step includes the step of pivoting said microphone boom about said first axis.

* * * * *